US006603860B1

(12) United States Patent
Taenzer et al.

(10) Patent No.: US 6,603,860 B1
(45) Date of Patent: Aug. 5, 2003

(54) APPARATUS AND METHOD FOR MONITORING MAGNETIC AUDIO SYSTEMS

(75) Inventors: Jon C. Taenzer, Palo Alto, CA (US); Jeffrey M. Sicurello, Fremont, CA (US)

(73) Assignee: GN ReSound North America Corporation, Redwood City, CA (US)

( * ) Notice: Subject to any disclaimer, the term of this patent is extended or adjusted under 35 U.S.C. 154(b) by 1484 days.

(21) Appl. No.: 08/902,196

(22) Filed: Jul. 29, 1997

Related U.S. Application Data

(63) Continuation of application No. 08/560,887, filed on Nov. 20, 1995, now abandoned.

(51) Int. Cl.[7] ..... H04R 29/00

(52) U.S. Cl. ..... 381/60; 381/328; 381/331; 381/312; 73/585; 600/25

(58) Field of Search ..... 73/585; 381/60, 381/79, 68–69.2, 328, 331; 600/25; 128/746

(56) References Cited

U.S. PATENT DOCUMENTS

| | | | | |
|---|---|---|---|---|
| 3,979,567 A | * | 9/1976 | Frye | 381/60 |
| 3,985,977 A | * | 10/1976 | Beaty et al. | |
| 4,065,647 A | * | 12/1977 | Frye et al. | |
| 4,957,478 A | | 9/1990 | Maniglia | |
| 5,010,575 A | * | 4/1991 | Marutake et al. | 381/331 |
| 5,091,952 A | * | 2/1992 | Williamson et al. | 381/68.4 |
| 5,226,086 A | * | 7/1993 | Platt | 381/60 |
| 5,259,032 A | | 11/1993 | Perkins et al. | |
| 5,425,104 A | | 6/1995 | Shennib | |

FOREIGN PATENT DOCUMENTS

| | | |
|---|---|---|
| FR | 2455820 | 11/1980 |
| WO | WO92-11738 | 7/1992 |
| WO | WO92-17991 | 10/1992 |

* cited by examiner

*Primary Examiner*—Duc Nguyen
(74) *Attorney, Agent, or Firm*—Bingham McCutchen LLP; David G. Beck

(57) ABSTRACT

An apparatus and method are provided for monitoring magnetic hearing systems by receiving a magnetic hearing system in an acoustic hearing aid testing device and then detecting the magnetic field output by the magnetic hearing system with a magnetic-to-acoustic testing device when the magnetic hearing system is being tested by the acoustic hearing aid testing device. The magnetic-to-acoustic testing device then develops an acoustic output signal representative of the detected magnetic field which may then be used in traditional acoustic monitoring techniques, such as performing a listening check of the magnetic hearing aid system or performing standard ANSI types of measurements, by the audiologist or tester.

3 Claims, 3 Drawing Sheets

APPARATUS AND METHOD FOR MONITORING MAGNETIC AUDIO SYSTEMS

This application is a continuation, of application Ser. No. 08/560,887, filed Nov. 20, 1995 now abandoned.

BACKGROUND

1. Field of the Invention

The present invention is directed to an apparatus and method for monitoring, quantifying, and verifying the performance of magnetic auditory prostheses and electromagnetic audio systems. More particularly, the present invention is directed to providing a magnetic-to-acoustic interface for magnetic auditory prostheses and electromagnetic audio systems so that they may be tested and evaluated with techniques as are used in acoustic testing and monitoring.

2. State of the Art

It is known to use hearing aids which provide an acoustic signal in the audible range and in the ultrasonic range to a user in order to modify the auditory characteristics of sound received by the user. Because hearing capabilities are quite different from individual to individual, the acoustic hearing aids must be adjusted to properly compensate for the hearing capability of the individual user. To adjust the acoustic hearing aids for optimum benefit to the user, a so-called "fitting" is performed to provide the appropriate auditory characteristics. The fitting process typically involves measuring the auditory characteristics of an individual's hearing, estimating the acoustic characteristics needed to compensate for the particular auditory deficiency measured, adjusting the auditory characteristics of the acoustic hearing aid so that the appropriate acoustic characteristics may be delivered, and verifying that these particular auditory characteristics do compensate for the hearing deficiency found by operating the acoustic hearing aid in conjunction with the individual. Acoustic hearing aids which store acoustic parameters and are programmable by a host computer or a programming device are also known. Standard techniques are known for these fittings which are typically performed by an audiologist, hearing aid dispenser, otologist, otolaryngologist, or other doctor or medical specialist.

Another type of known auditory prostheses utilizes electromagnetic energy to vibrate the middle ear structures or the tympanic membrane, a so-called "magnetic hearing aid system." A small magnet may either be placed on the structures or membrane or attached to the structures or membrane by a surgical procedure or with an adhesive. An electromagnetic coil is then placed inside or outside of the external auditory canal for producing electromagnetic fields which vibrate the magnet. As a result, the ear structures are vibrated to produce the sensation of enhanced hearing to the user of the magnetic hearing aid system. Examples of such magnetic hearing aid and electromagnetic audio systems are described in U.S. Pat. No. 4,957,478 to Maniglia, U.S. Pat. No. 5,259,032 to Perkins et al., and U.S. Pat. No. 5,425,104 to Shennib.

Magnetic hearing aid systems produce electromagnetic energy from electrical signals rather than acoustic energy as is produced in the acoustic hearing aids. Because the electromagnetic energy has the same amplitude and frequency variation characteristics as the driving electric signal, audible sounds of the same characteristics as the original source signals are produced from vibrations of the magnet placed on the inner ear structure which are induced by the electromagnetic fields. Therefore, a problem exists with these magnetic hearing aid systems because an acoustic signal is not generated. As a result, conventional acoustic fitting equipment and procedures cannot be used to monitor and verify the performance of these electromagnetic audio systems. For instance, even a simple listening check of the magnetic hearing aid system cannot be conducted because the magnetic hearing aid systems do not produce an acoustic output. Also, when manufacturing magnetic hearing aid systems, it is necessary to perform production testing, similar to tests performed in the fitting process, to ensure that the systems meet the required specifications before shipping.

In addition, the performance of the electromagnetic audio systems cannot be evaluated with standard acoustic couplers because these standard acoustic couplers are not designed to respond to electromagnetic energy. Therefore, apparatus and techniques are desired for monitoring, quantifying and verifying the functioning of electromagnetic audio systems. One way to accomplish this monitoring, quantifying, and verifying would be to design completely new equipment and procedures for these electromagnetic audio systems. However, such an approach is very costly and would introduce new and additional equipment and procedures that are unfamiliar to the audiologist or fitter of the magnetic hearing aid systems which undesirably requires new training and more laboratory space. Accordingly, procedures are desired for monitoring, quantifying, and verifying magnetic audio systems so that additional training, costs and equipment for monitoring, quantifying, and verifying magnetic audio systems are minimized, which preferably makes use of conventional acoustic testing techniques.

SUMMARY OF THE PRESENT INVENTION

The present invention is directed to an apparatus and method for monitoring, quantifying, and verifying the operation of electromagnetic audio systems. Because electromagnetic audio systems do not have an acoustic output, conventional acoustic hearing aid test systems as presently configured cannot be used to monitor electromagnetic audio systems. This invention allows electromagnetic audio systems to interface with commercial acoustic hearing aid test systems so that known acoustic procedures and equipment may be used to monitor, quantify, and verify the performance of electromagnetic audio systems.

More particularly, the present invention monitors electromagnetic audio systems by disposing the electromagnetic audio system in an acoustic hearing aid testing device and then detecting the magnetic field output by the electromagnetic audio system with a magnetic-to-acoustic converter when the electromagnetic audio system is being tested by the acoustic hearing aid testing device. The magnetic-to-acoustic converter then develops an acoustic output signal representative of the detected magnetic field which may then be used in traditional qualitative and quantitative acoustic monitoring techniques, such as performing a listening check of the electromagnetic audio system or performing standardized measurements, by the audiologist or tester. Also, presently available commercial acoustic hearing aid testing devices such as Frye Fonix, Rastronics, Acoustimed, AudioScan, B&K, Interacoustics, Madsen, Saico, or Sarffa electroacoustic hearing aid analyzers may be used to monitor, quantify, and verify the performance of electromagnetic audio systems.

BRIEF DESCRIPTION OF THE DRAWINGS

The present invention will become more fully understood from the detailed description given hereinbelow and the accompanying drawings which are given by way of illustration only, and thus are not limitative of the present invention, wherein:

FIG. 1(*b*) illustrates the placement of a magnet transducer assembly of the electromagnetic audio system on the tympanic membrane;

FIG. 2(*b*) illustrates a placement of the magnetic audio system for monitoring by the apparatus illustrated in FIG. 2(*a*);

FIGS. 2(*c*) and 2(*d*) illustrate examples of possible placements of the magnetic-to-acoustic converter according to embodiments of the present invention on a user;

DETAILED DESCRIPTION

As electromagnetic audio systems become more widely used, new techniques and equipment are necessary to assess their performance because these systems rely on electrical signals to produce electromagnetic energy rather than acoustic energy. The produced electromagnetic energy has the same amplitude and frequency variation characteristics as the driving electrical signal. The electromagnetic fields then induce vibrations of a magnetic structure attached to the ear drum, middle ear structure or skull of the user and produce audible sounds of the same characteristics as the original source signals. One example of such a magnetic audio system is disclosed in U.S. Pat. No. 5,259,032 to Perkins et al., which is hereby incorporated by reference. In the magnetic audio system of Perkins et al., a magnet is worn by the user and is positioned on the tympanic membrane as part of a contact transducer assembly. The coils that produce the magnetic fields are characteristically "remote" from the transducer assembly such that the coils are not connected to the transducer assembly by tangible means. The coil assembly may be worn in the ear canal or on a portion of the body which may be hidden beneath clothing. Vibrational motions of the transducer are perceived by the user of the electromagnetic audio system as sound. One example of such an electromagnetic audio system is disclosed in U.S. Pat. No. 5,425,104 to Shennib, which is hereby incorporated by reference.

Figure 1A:
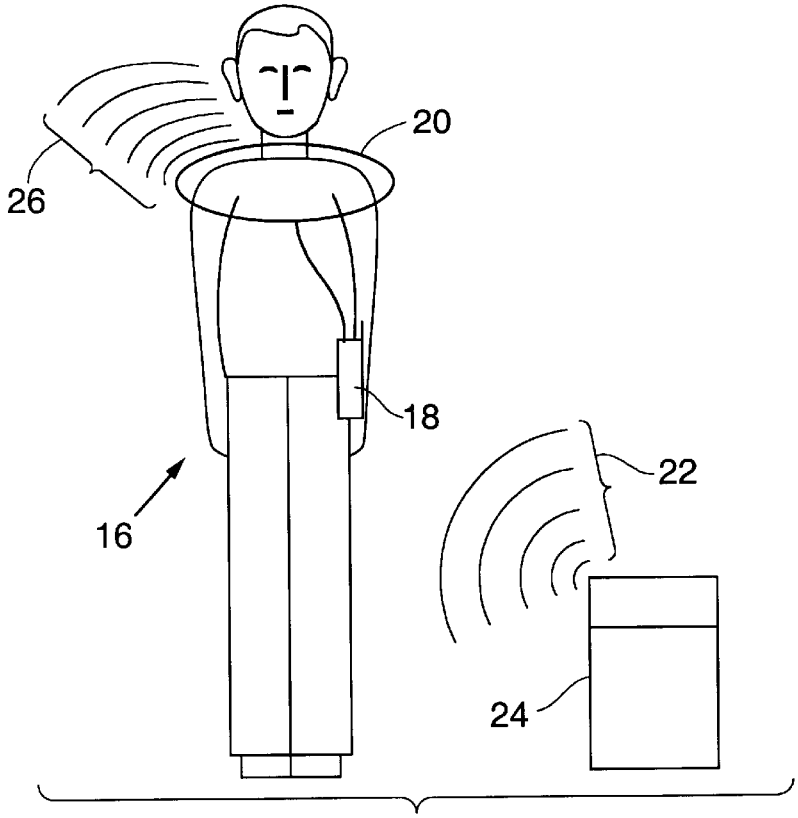
FIGS. 1(*a*) shows an exemplary embodiment of an electromagnetic audio system according to the present invention.
Figure 1B:
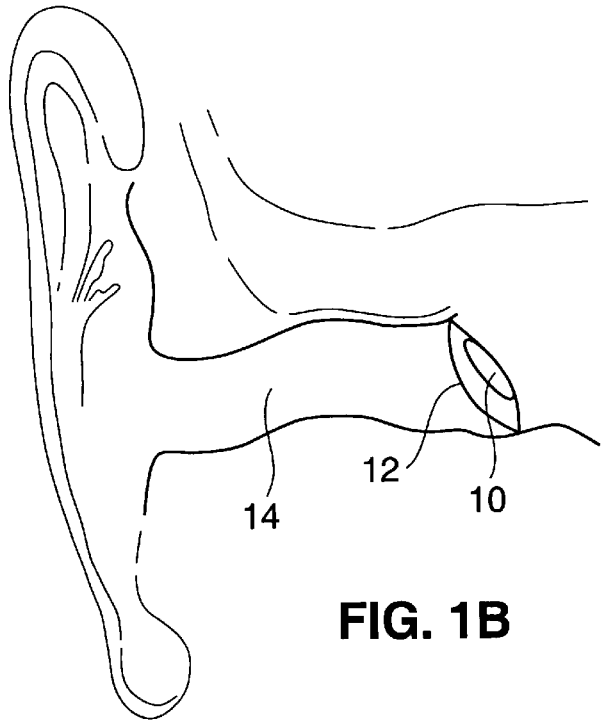
Figure 2A:
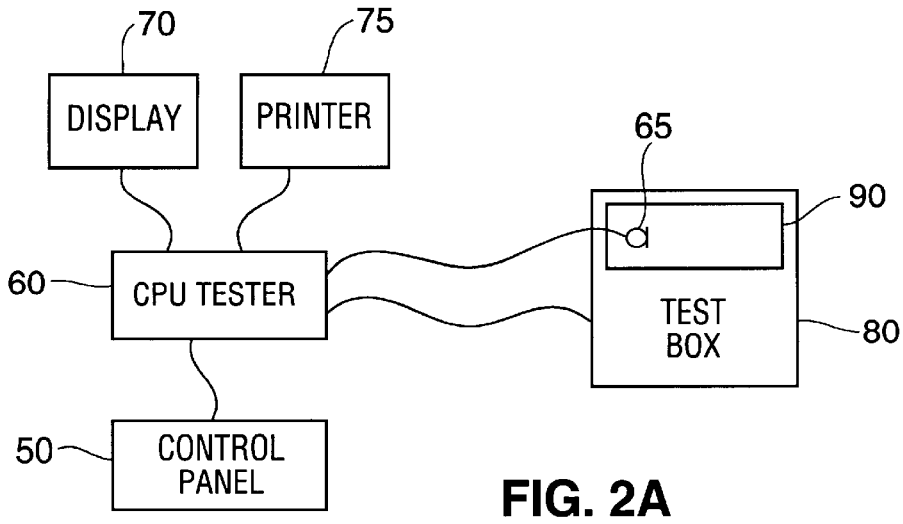
FIG. 2(*a*) illustrates a block diagram of an apparatus for monitoring acoustic audio systems that may be modified to be used with an embodiment of the present invention.
Figure 2B:
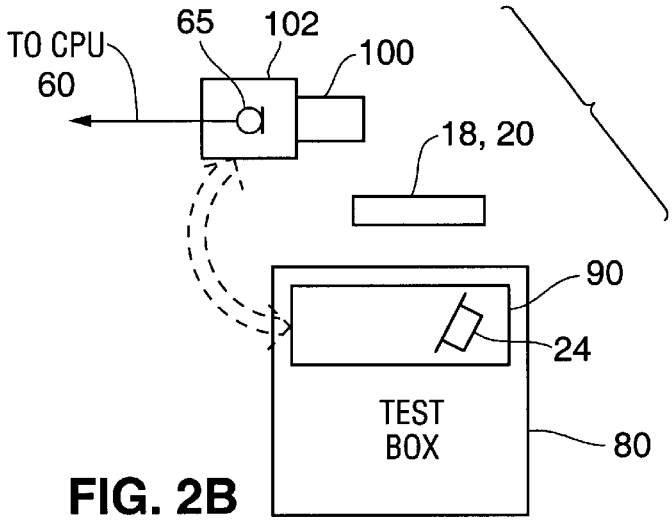
Figure 2C:
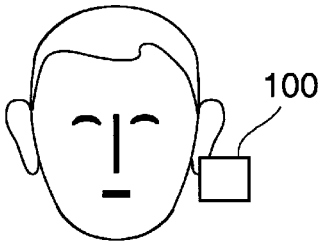
Figure 2D:
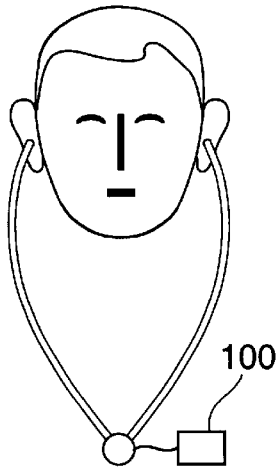

FIG. 1(*a*) shows a magnetic audio system that may be tested by using an embodiment of the present invention and FIG. 1(*b*) shows the placement of a magnet transducer assembly of the magnetic audio system on the tympanic membrane. In FIG. 1(*b*), a magnet transducer assembly 10 is supported on the tympanic membrane 12 in the ear canal 14 of the user. The user 16 may wear a receiver/amplifier unit 18 as illustrated in FIG. 1(*a*). The receiver/amplifier unit 18 may be an FM receiver or a microphone/amplifier connected to a coil for example. The user 16 may wear a coil 20 that is connected to and driven by the receiver/amplifier unit 18 as illustrated in FIG. 1(*a*).

In operating this magnetic audio system, FM radio frequency signals 22 from a wireless FM transmitter 24 may be detected at the FM receiver/amplifier unit 18 as illustrated in FIG. 1(*a*). The receiver/amplifier unit 18 then causes the coil 20 to transmit a magnetic field 26 corresponding to the audio signals. The magnet transducer assembly 10 vibrates in response to the magnetic field 26 which causes vibrations to be experienced at the tympanic membrane 12 which has the transducer assembly 10 attached thereto. As a result, the user 16 perceives audio encoded FM radio frequency signals 22 as sounds.

A suitably sized magnet to allow correction of a hearing impairment may be used as the magnet transducer assembly and the coil 20 is preferably designed to be of a large diameter (typically 20 cm or more in diameter) so that the magnet is almost always positioned within a substantially uniform electromagnetic field. Thereby, movement of the magnet with respect to the coil position will not significantly affect the interaction between variations in the magnetic field strength and displacement of the magnet (the equivalent sound pressure level).

An apparatus for monitoring the electromagnetic audio systems will be described with reference to FIGS. 2(*a*) and 2(*b*). The main components of an electroacoustic hearing aid test analyzer are shown in FIG. 2(*a*). In FIG. 2(*a*), an electroacoustic hearing aid test analyzer is comprised of a test box 80 having an acoustic chamber 90 for receiving the device to be tested, a CPU 60 for performing the tests, a calibrated instrument microphone 65, a keyboard or control panel 50 for selecting and/or programming the CPU tests, a display 70 and a printer 75 for providing an output of the tested device. Examples of presently available commercial electroacoustic hearing aid test analyzers include systems manufactured by Acoustimed, AudioScan, B&K, Frye, Interacoustics, Madsen, Rastronics, Saico, and Sarffa. These known commercial acoustic hearing aid testing systems are well-known and allow the audiologist or tester to perform standard programmed ANSI-type measurements of the acoustic hearing aid performance. Thereby, ANSI and IEC standards for hearing aid measurements may be supported.

These systems work by providing known acoustic signals (amplitude, frequency, spectrum, etc.) to the microphone of an acoustic hearing aid which is placed in the acoustic chamber and measuring the acoustic output of the acoustic aid by a calibrated instrument quality test microphone connected to the acoustic output of the aid by an acoustic coupler. Parameters such as acoustic gain, frequency, response, etc., can then be measured for the device being tested to verify, quantify and monitor. For example, the acoustic device can be tested, reprogrammed and retested to verify if the program changes were correctly implemented by the hearing aid. Without an acoustic output signal, magnetic hearing aids present a problem with such standard acoustic test equipment.

FIG. 2(*b*) illustrates how the electromagnetic audio system described in FIGS. 1(*a*) and 1(*b*) may interface with a standard acoustic hearing aid testing system described in FIG. 2(*a*) by using the present invention. The receiver/amplifier unit 18 and the coil 20 may be placed outside the acoustic chamber 90, preferably on top of the test box 80, and the FM transmitter 24 may be placed in the acoustic chamber 90 as illustrated in FIG. 2(*b*). In order to permit the electromagnetic audio system to interface with the acoustic hearing aid testing system, a magnetic-to-acoustic converter 100 may then be placed either inside of the acoustic chamber 90 or outside of the acoustic chamber 90 in proximity to the coil 20. A stand (not shown) may be provided which allows the coil 20 to be mounted in the vicinity of the test box 80. In addition, a coupler 102, which includes the calibrated instrument microphone 65, may be connected with the magnetic-to-acoustic converter 100 so that its output is received by the CPU 60. Thereby, the magnetic to acoustic converter 100 may pick-up magnetic fields generated by the coil 20 and provide an acoustic output. The output of the magnetic-to-acoustic converter 100 may then either be coupled to the microphone 65 of the test system for evaluation by the CPU 60 or connected for listening to a standard audiological stethoscope or an ear mold.

FIGS. 2(*c*) and 2(*d*) illustrate two examples for possible placements of the magnetic-to-acoustic converter 100 according to embodiments of the present invention on a user. In FIG. 2(*c*), the magnetic-to-acoustic converter 100 is placed on the ear of the user, much like a conventional BTE hearing aid. In FIG. 2(*d*), the user listens to the output of the magnetic-to-acoustic converter 100 via a standard audiological stethoscope 110, for example.

The input to the magnetic-to-acoustic converter 100 is the modulated magnetic field created by the coil 20. When the inventive device is used as a quick verification listening tool, the acoustic output of the magnetic-to-acoustic converter 100 may be monitored by listening. When the magnetic-to-acoustic converter 100 is connected to the CPU 60 of the acoustic tester, the output of the magnetic-to-acoustic converter 100 may be used to produce graphs or data which characterize the functionality of the electromagnetic audio system. To provide accurate testing, this device should be of higher instrument quality then standard hearing aid devices. Thereby, the magnetic-to-acoustic converter 100 effectively performs two basic functions. The first function is an interface for obtaining standard coupler measurements and the second function is to provide a listening device for non-electromagnetic hearing system users. It is understood that this inventive device may be used to monitor, quantify and verify the performance of electromagnetic audio systems both with and without the presence of the transducer assembly in a user. As a result, the audiologist or tester can either perform a listening check of the magnetic hearing system or use the CPU 60 of the acoustic hearing aid testing system to quantify and monitor the performance of the electromagnetic audio system being tested.

Figure 3:
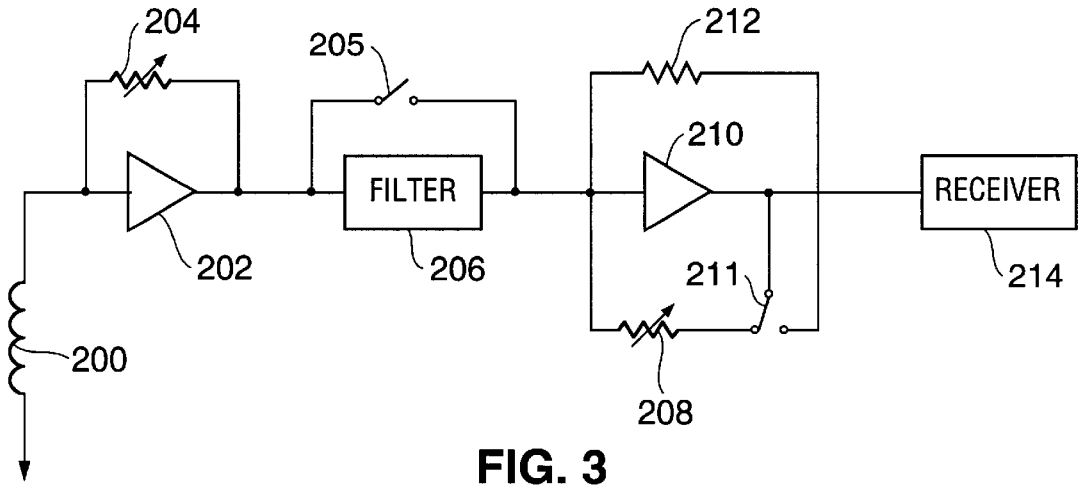
FIG. 3 illustrates a circuit diagram for the inventive device used in one embodiment of the present invention.

FIG. 3 illustrates one example of a circuit diagram for the magnetic-to-acoustic device 100 in one embodiment of this invention. The magnetic-to-acoustic testing device may be a small battery operated device having a magnetic pickup coil or telecoil 200 which is appropriate to the magnetic field strength of the receiver/amplifier unit 18. The output of the pickup coil 200 may then be amplified by an amplifier 202 and potentiometer 204. The amplifier 202 is preferentially configured to correct the frequency response of the pickup coil 200 so that a flat characteristic is achieved across the entire frequency range of interest. The amplified signal may then be input to a filter 206 which filters the amplified signal to mimic the psychoacoustic drive response by the user of the electromagnetic audio system. The filter 206 can be used for monitoring electromagnetic audio systems because the filter 206 will give the listener, such as an audiologist, the same frequency characteristic produced by the magnet transducer to the user. However, the filter 206 can be switched off by a switch 205 to produce a flat frequency response for test purposes. The output of the filter 206 may then be input to an amplifier 210 which is connected with a switch 211 to either a potentiometer 208 or a resistor 212. When the switch 211 connects the potentiometer 208 to the circuit, the volume of the output may be controlled to the desired listening level at the receiver 214. Otherwise, if the switch 211 disconnects the potentiometer 208 from the circuit, the output of the amplifier 210 is directly output to a calibrated path. The resulting calibrated acoustic output may be connected to the microphone 65 of the acoustic tester through a standard coupler, such as a 2-cc coupler, for example.

Figure 4:
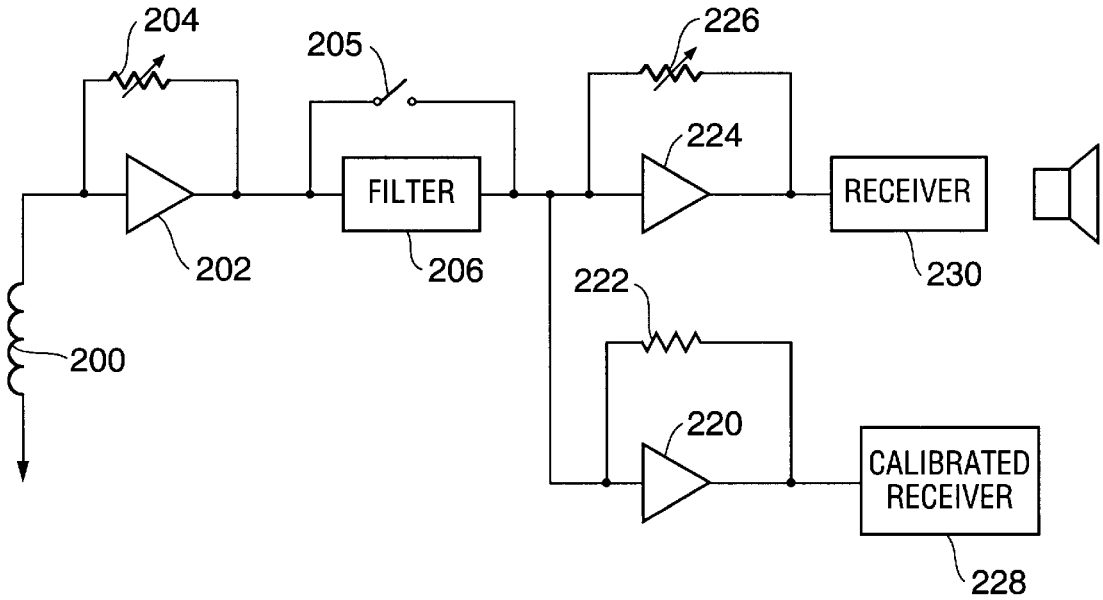
FIG. 4 illustrates a circuit diagram for the inventive device in another embodiment of the present invention.

FIG. 4 illustrates another example of a circuit configuration for the magnetic-to-acoustic converter 100 in another embodiment of the present invention. FIG. 4 differs from the circuit illustrated in FIG. 3 after the output of the filter 206 and a discussion of this circuit will begin from this point. In FIG. 4, signal splitting to two paths is provided at the output of the filter 206. One path leads to a volume controlled output for listening at a receiver 230 through an amplifier 224 and a potentiometer 226. The potentiometer 226 may be used by the listener to set a comfortable listening level, since calibrated functionality is not needed in this mode of use. Another path from the output of the filter 206 leads to a calibrated receiver 228 through an amplifier 220 and a resistor 222. The calibrated receiver may then be coupled to microphone 65 of the acoustic tester via a standard coupler such as a 2-cc coupler.

The magnetic-to-acoustic converter 100 is preferentially packaged in a standard BTE case or any other standard hearing aid case or may be packaged in a standard off-the-shelf enclosure which is modified as necessary for component connection purposes. When packaged in a BTE case, a familiar-looking and a relatively inexpensive device may be made which uses readily available components. However, the BTE receiver typically has poor frequency response and the installation of the electronics and later repairs or redesigns may be difficult to physically perform when a BTE case is used. If a standard off-the-shelf enclosure is used, the components may be more expensive and difficult to obtain. However, the off-the-shelf enclosure may provide an external receiver having a frequency response which is better than the BTE receiver and this enclosure may provide more flexibility in circuit designing.

When the BTE package is used, a standard BTE kit (case, coupler, etc.) and receiver may be used. To listen to the audio output, the audiologist or tester may then connect a normal ear-mold or a standard plastic stethoscope to the sound nozzle (ear hook) of the magnetic-to-acoustic converter 100. Alternatively, a standard receiver, such as a Hal-Hen #2103, and a cord may be used with an off-the-shelf enclosure. The audiologist or tester may then plug in the cord into the magnetic-to-acoustic converter 100 and connect the receiver to a stethoscope or the receiver may be directly connected into a standard 2-cc coupler of the test box 80.

The pickup coil 200 of the magnetic-to-acoustic converter 100 should be appropriate to the magnetic field produced by the coil 20. The receivers 214, 228, and 230 should deliver acoustic signals appropriate for comfortable listening and standard coupler measurements respectively. The acoustic output of the magnetic-to-acoustic converter 100 should adapt to a standard coupler and to an ear mold of the audiologist or tester. The coupler and receivers should be designed or compensated to provide a flat response over the frequency range. For example, the coupler may be either a snap ring button receiver (similar to a body style hearing aid) or an ear hook or a nozzle that can be inserted into a standard No. 13 tubing (similar to a BTE style hearing aid). The receivers 214, 228, and 230 should be at least one order or magnitude less sensitive to magnetic fields than the telecoil 200 so that the magnetic to acoustic converter 100 does not register its response via direct stimulation of a magnetically driven receiver. The inventive test system should have distortion values at least one order of magnitude lower than the magnetic audio system being tested so that the percentage distortion values measured by the audio test system as part of the ANSI measurement protocol are not falsely elevated.

The magnetic-to-acoustic converter 100 may further include a function switch of dual test modes for standard coupler measurements. One test mode would function as a test of the electromagnetic performance of the magnetic hearing system without a transducer assembly being associated with a user. This mode gives an accurate measurement of the physical characteristics of the magnetic hearing aid coil driven system and can be used during manufacturing test to verify correct operation, for example. Other test modes would be for the electromagnetic hearing system when the transducer assembly is in place for a user and would incorporate psychoacoustic transfer functions. This second test mode may then provide a prediction of expected or real ear performance. When the output of the inventive device is input to the CPU 60, standardized measurements may be made of the magnetic audio system and relative changes in gain, output, compression, and frequency equalization can be evaluated to supplement psychoacoustic data collection and optimize the acoustic correction for the particular hearing impairment of the user.

Although the embodiments of the present invention have been discussed with reference to a specific magnetic hearing aid system, this invention may be used in any other electromagnetic hearing system which vibrates the middle ear structures, the tympanic membrane or the skull to enhance the hearing of a user.

This invention provides an apparatus and method for monitoring, quantifying, and verifying the performance of magnetic audio systems with known techniques and equipment. Accordingly, the audiologist or tester of the magnetic audio systems may monitor and test the system with minimal training and additional equipment costs.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. Test apparatus for a magnetic drive hearing device, including a drive coil for diving an ear lens magnet removably affixed to the ear drum of a wearer, the test apparatus comprising:

an acoustic chamber;

a stand for mounting the drive coil in the vicinity of the acoustic chamber; and a magnetic-to-acoustic converer situated in proximity to the driving coil.

2. The apparatus of claim 1, wherein the magnetic-to-acoustic converter occupies a housing of a hearing-aid earpiece.

3. The apparatus of claim 1, wherein the magnetic-to-acoustic converter produces a calibrated acoustic output.

* * * * *